US007874853B2

(12) United States Patent
Chiang et al.

(10) Patent No.: US 7,874,853 B2
(45) Date of Patent: Jan. 25, 2011

(54) CONVERTER WITH POSITION ADJUSTABLE PLUG

(75) Inventors: Yung-Hsu Chiang, Taichung Hsien (TW); Hiroshi Ozaki, Nagoya (JP)

(73) Assignees: Buffalo, Inc., Nagoya (JP); Unifive Technology Co., Ltd., Fongyuan (TW)

( * ) Notice: Subject to any disclaimer, the term of this patent is extended or adjusted under 35 U.S.C. 154(b) by 0 days.

(21) Appl. No.: 12/627,759

(22) Filed: Nov. 30, 2009

(65) Prior Publication Data

US 2010/0173526 A1 Jul. 8, 2010

(30) Foreign Application Priority Data

Jan. 6, 2009 (TW) ..... 98200087 U

(51) Int. Cl.
*H01R 29/00* (2006.01)

(52) U.S. Cl. ..... 439/173; 439/640

(58) Field of Classification Search ..... 439/620.1, 439/170, 172, 173, 174, 650, 640, 956
See application file for complete search history.

(56) References Cited

U.S. PATENT DOCUMENTS 6,669,495 B2 * 12/2003 Philips et al. ..... 439/170
6,942,508 B2 * 9/2005 Wong ..... 439/171
7,168,969 B1 * 1/2007 Wang ..... 439/173
7,273,384 B1 * 9/2007 So ..... 439/172
7,381,059 B2 * 6/2008 Wong ..... 439/22

OTHER PUBLICATIONS

U.S. Appl. No. 12/627,522, filed Nov. 30, 2009, Chiang et al.

* cited by examiner

*Primary Examiner*—Hae Moon Hyeon
(74) *Attorney, Agent, or Firm*—Oblon, Spivak, McClelland, Maier & Neustadt, L.L.P.

(57) ABSTRACT

A converter has a casing and a plug. The casing has a mounting recess, multiple position posts, multiple conductive slices and multiple mounting protrusions. The mounting recess is formed in the casing. The position posts are formed on and protrude from the mounting recess. The conductive slices are mounted around the position posts. The mounting protrusions are formed on the mounting recess. The plug is detachably mounted on the casing and has an escutcheon, an engaging protrusion and multiple terminals. The escutcheon covers the mounting recess. The engaging protrusion is formed on the escutcheon, is mounted in the mounting recess and has a position groove and multiple holding grooves. The position is annular formed in the engaging protrusion and is mounted around the position posts. The holding grooves are formed on the engaging protrusion and engage the mounting protrusions. The terminals are formed on the escutcheon.

6 Claims, 6 Drawing Sheets

CONVERTER WITH POSITION ADJUSTABLE PLUG

BACKGROUND OF THE INVENTION

1. Field of the Invention

The present invention relates to a converter, and more particularly to a converter that can adjust the direction of a plug relative to a casing of the converter.

2. Description of Related Art

A conventional converter is used to transform and rectify voltage of a power source and has a casing and a plug. The casing has an interior, a conversion module, a connection surface and a mounting recess. The conversion module is mounted in the interior of the casing. The mounting recess is formed in the connection surface of the casing. The plug is detachably mounted in casing, selectively mounted in the power source and has a connection surface and a mounting panel. The mounting panel is formed on and protrudes from the connection surface of the plug and is detachably mounted in the mounting recess of the casing.

Although, the plug can be detachably connected to the casing of the conventional converter by the mounting recess and the mounting panel. However, the connection direction between the plug and the casing of the conventional converter is fixed and cannot be adjusted or changed. When the conventional converter is interfered with the object or the structure that mounted around the power outlet and the plug of the conventional converter cannot mount with the power outlet and this is inconvenient in use.

To overcome the shortcomings, the present invention provides a converter to mitigate or obviate the aforementioned problems.

SUMMARY OF THE INVENTION

The main objective of the present invention is to provide a converter that can adjust the direction of a plug relative to a casing of the converter.

The converter in accordance with the present invention has a casing and a plug. The casing has a mounting recess, multiple position posts, multiple conductive slices and multiple mounting protrusions. The mounting recess is formed in the casing. The position posts are formed on and protrude from a bottom of the mounting recess. The conductive slices are mounted around the position posts and connected to the bottom of the mounting recess. The mounting protrusions are formed on the mounting recess. The plug is detachably mounted on the casing and has an escutcheon, an engaging protrusion and multiple terminals. The escutcheon covers the mounting recess. The engaging protrusion is formed on the escutcheon, is mounted in the mounting recess and has a position groove and multiple holding grooves. The position is annular formed in the engaging protrusion and is mounted around the position posts. The holding grooves are formed on the engaging protrusion and engage the mounting protrusions. The terminals are formed on the escutcheon Other objectives, advantages and novel features of the invention will become more apparent from the following detailed description when taken in conjunction with the accompanying drawings.

DETAILED DESCRIPTION OF THE PREFERRED EMBODIMENT

Figure 1:
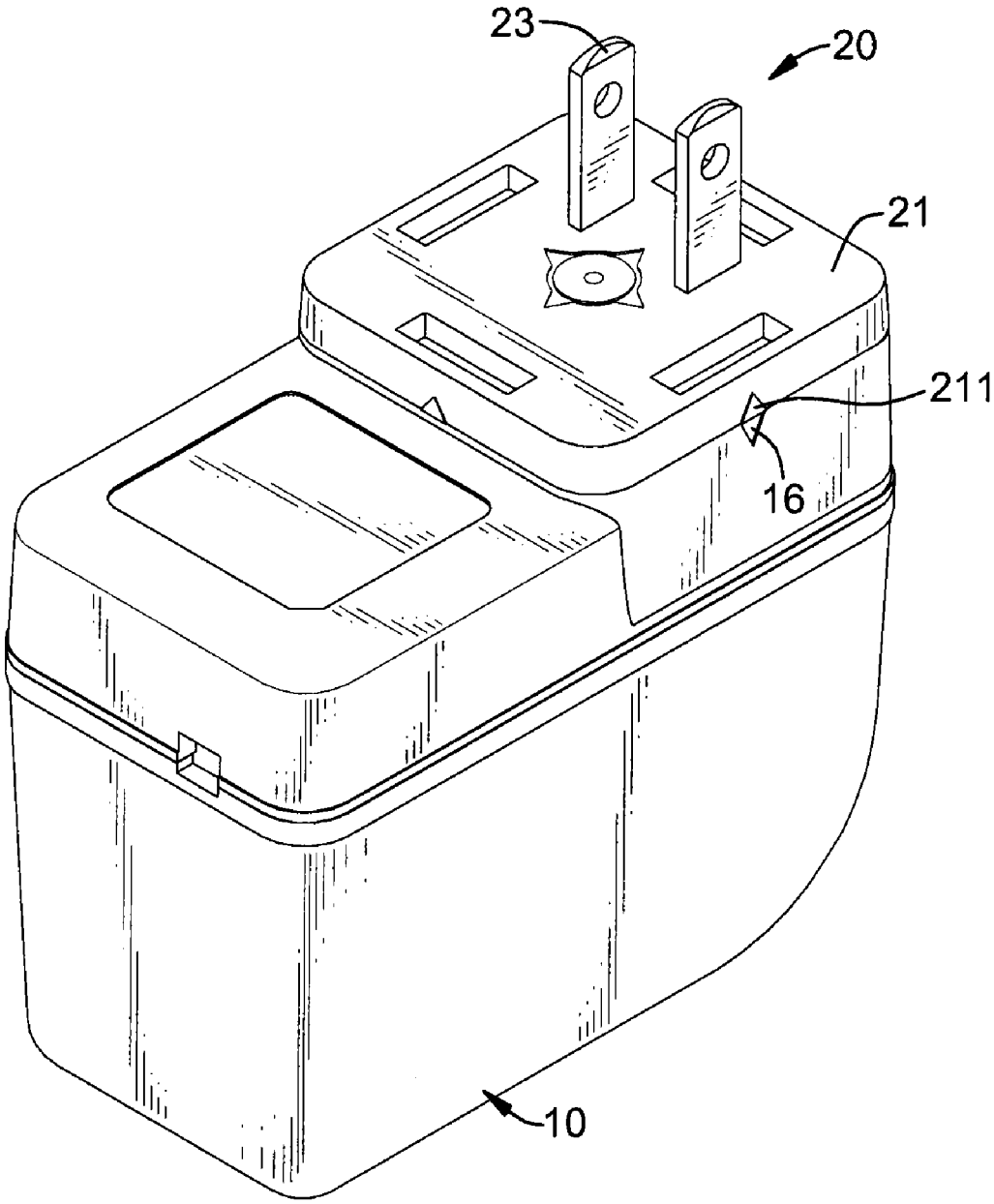
FIG. 1 is a perspective view of a converter in accordance with the present invention.
Figure 2:
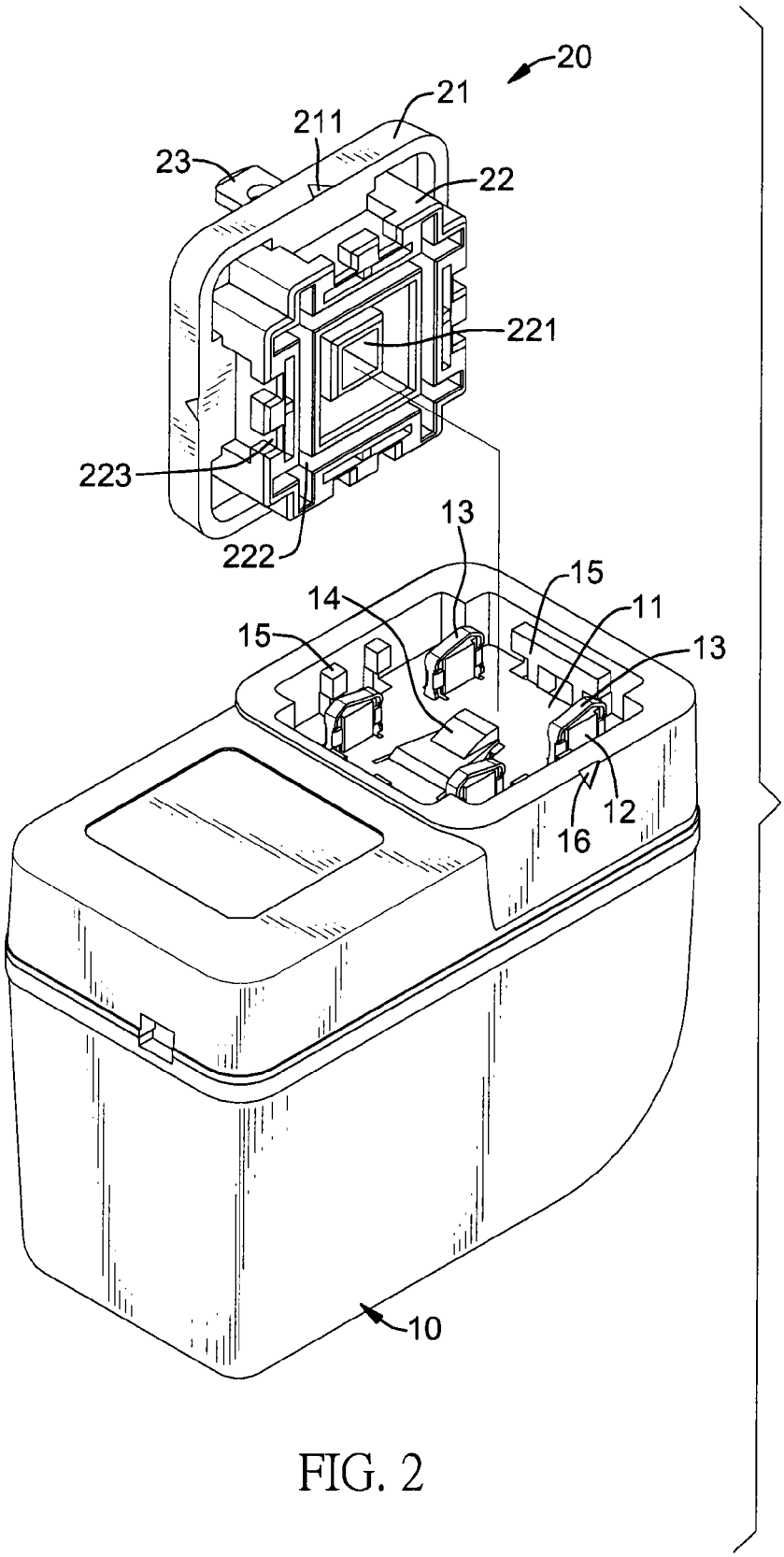
FIG. 2 is an exploded perspective view of the converter in FIG. 1.

With reference to FIGS. 1 and 2, a converter in accordance with the present invention comprises a casing (10) and a plug (20).

The casing (10) has a connection side, an external surface, a mounting recess (11), multiple position posts (12), multiple conductive slices (13), an engaging tab (14), multiple mounting protrusions (15) and multiple datum marks (16).

The mounting recess (11) is formed in the connection side of the casing (10) and has a bottom, an annular sidewall and a center.

The position posts (12) are formed on and protrude from the bottom of the mounting recess (11) around the center of the mounting recess (11) and each position post (12) has an external surface, and may be four position posts (12) formed on and protrude from the bottom of the mounting recess (11), and each pair of adjacent position posts (12) have a specified distance.

The conductive slices (13) are mounted around the position posts (12) and connected to the bottom of the mounting recess (11).

The engaging tab (14) is formed on and protrudes from the bottom of the mounting recess (11) near the center of the mounting recess (11) and between the position posts (12).

The mounting protrusions (15) are formed on the annular sidewall of the mounting recess (11).

The datum marks (16) are formed on the external surface of the casing (10) near the connection side.

The plug (20) is detachably mounted on the casing (10) and has an escutcheon (21), an engaging protrusion (22) and multiple terminals (23).

The escutcheon (21) covers the mounting recess (11) of the casing (10) and has an outer side, a connection side, an external surface and multiple confirm marks (211). The confirm marks (211) are formed on the external surface of the escutcheon (21) and correspond to and align with the datum marks (16) of the casing (10).

The engaging protrusion (22) is formed on and protrudes from the connection side of the escutcheon (21), corresponds to and is mounted in the mounting recess (11) of the casing (10) and has a center, an outer sidewall, an engaging hole (221), a position groove (222) and multiple holding grooves (223). The engaging hole (221) is formed in the center of the engaging protrusion (22) to engage the engaging tab (14) of the casing (10). The position groove (222) is annular formed in the engaging protrusion (22) around the engaging hole (221) and is mounted around the position posts (12) of the casing (10). The holding grooves (223) are formed on the outer sidewall of the engaging protrusion (22) and engage the mounting protrusions (15) of the casing (10).

The terminals (23) are formed on and protrude from the outer side of the escutcheon (21). Preferably, the plug (20) has two terminals (23) formed on and protrude from the outer side of the escutcheon (21) and contacted with two of the conductive slices (13) of the casing (10), and a distance between the terminals (23) is equal to or smaller than the specified distances between the adjacent position posts (12).

Figure 3:
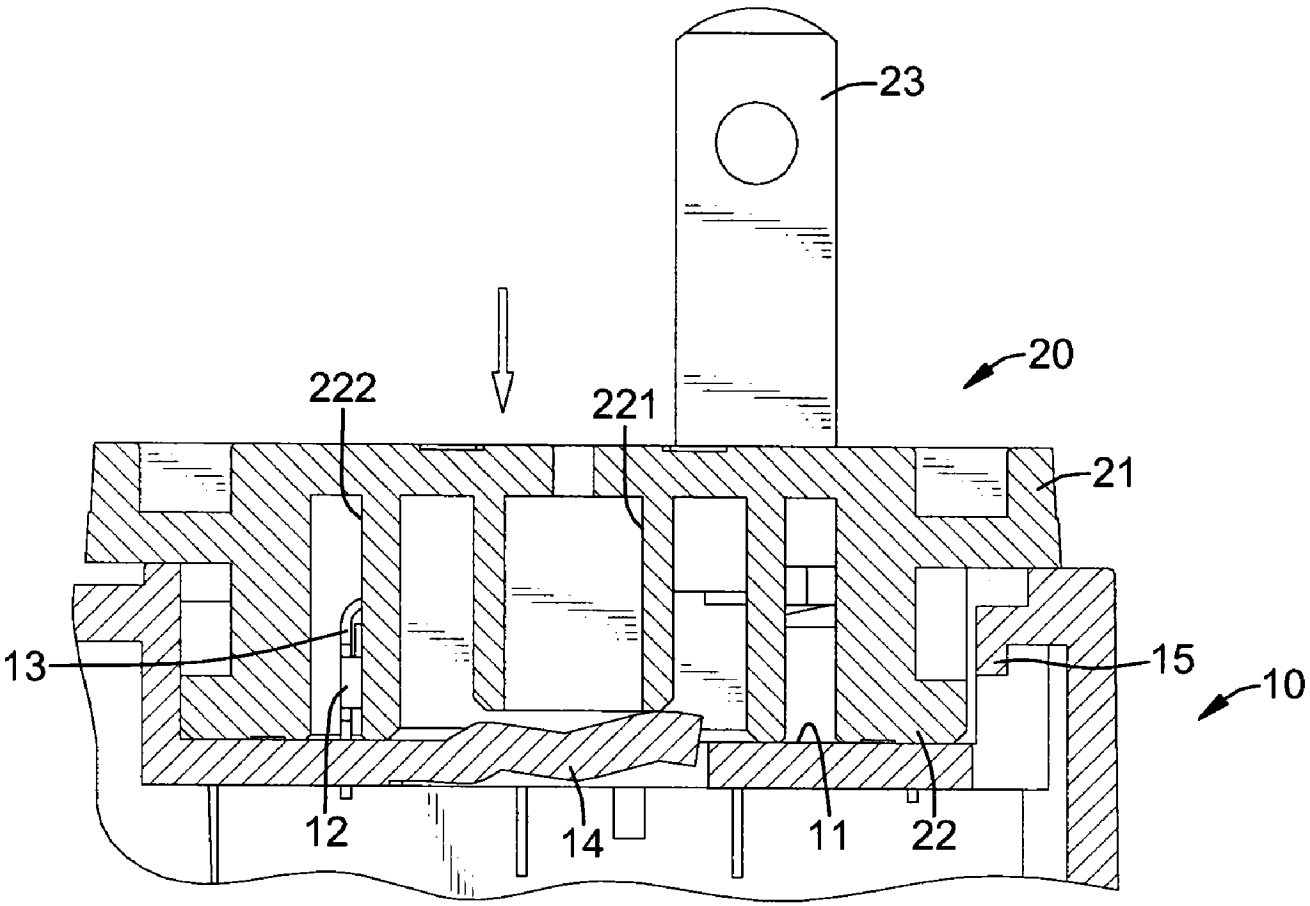
FIGS. 3 and 4 are operational side views in partial cross section of the converter in FIG. 2 showing that a plug being mounted to a casing of the converter.
Figure 4:
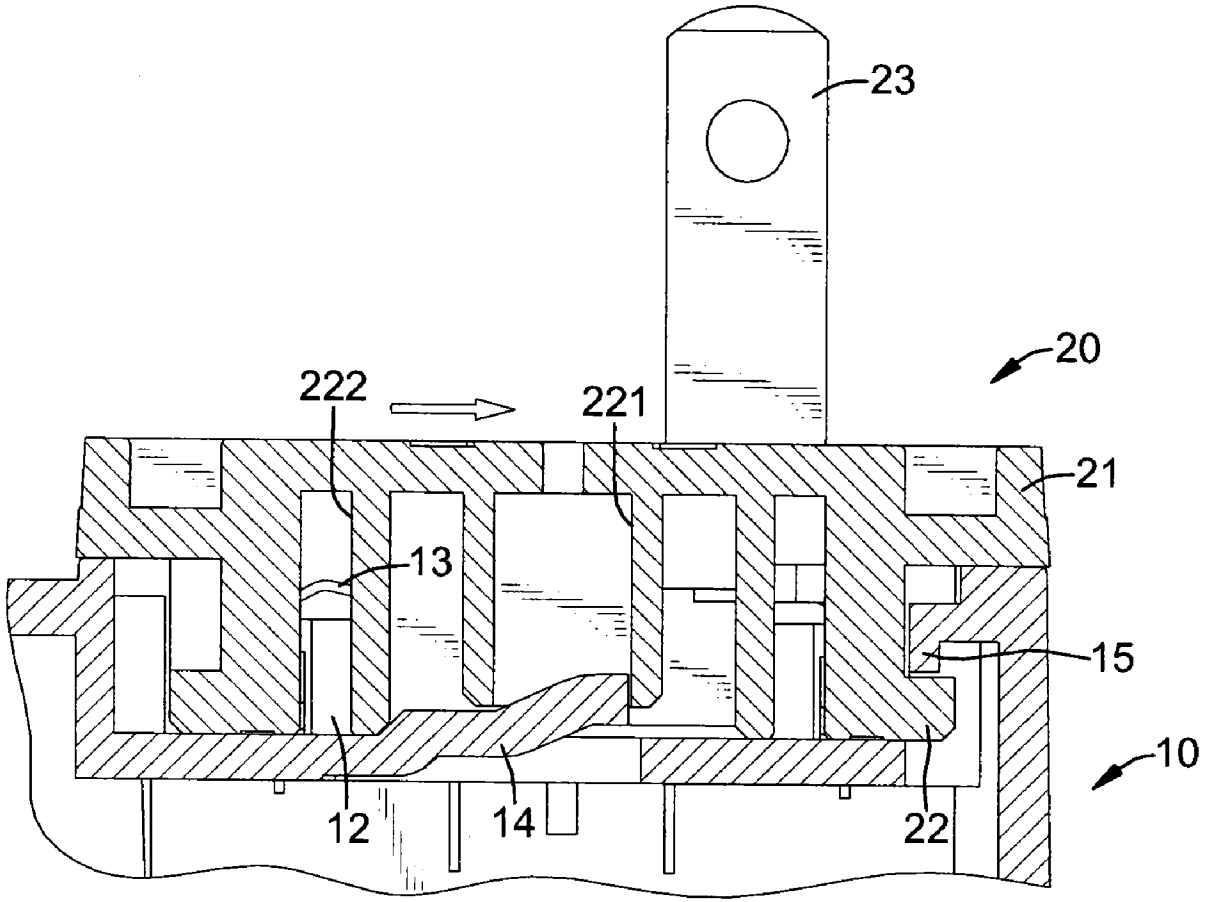

With further reference to FIGS. 3 and 4, the plug (20) is mounted on the casing (10) by inserting the engaging protrusion (22) of the plug (20) into the mounting recess (11) to make the position groove (222) mounting around the position posts (12) of the casing (10), moving the plug (20) relative to the mounting recess (11) of the casing (10), when the confirm marks (211) of the escutcheon (21) align with the datum marks (16) of the casing (10), the engaging hole (221) of the engaging protrusion (22) will engage the engaging tab (14) of the casing (10). At the same time, the mounting protrusions (15) in the mounting recess (11) of the casing (10) will engage the holding grooves (223) of the engaging protrusion (22) to hold the plug (20) securely with the casing (10).

Figure 5:
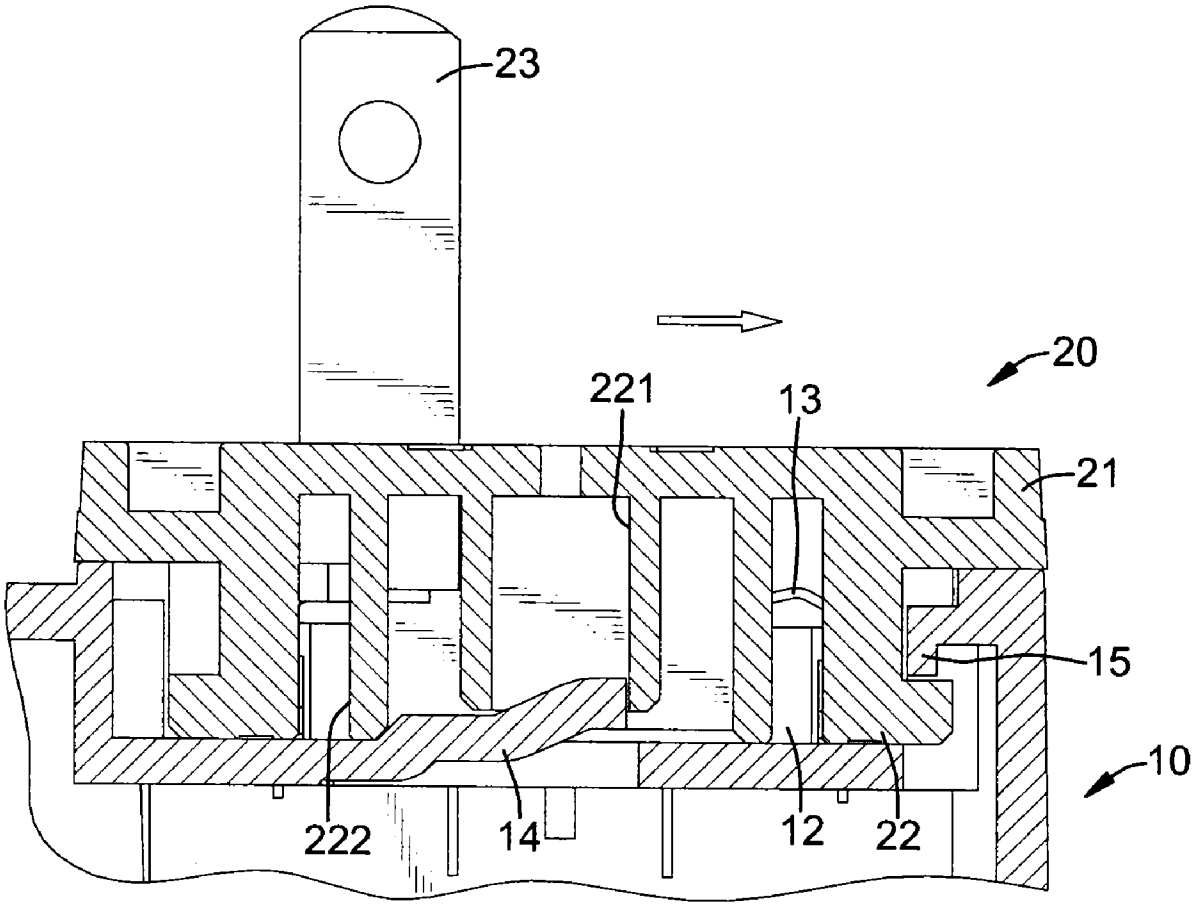
FIG. 5 is another operational side view in partial cross section of the converter in FIG. 2 showing that the plug being mounted to the casing of the converter in a different direction.
Figure 6:
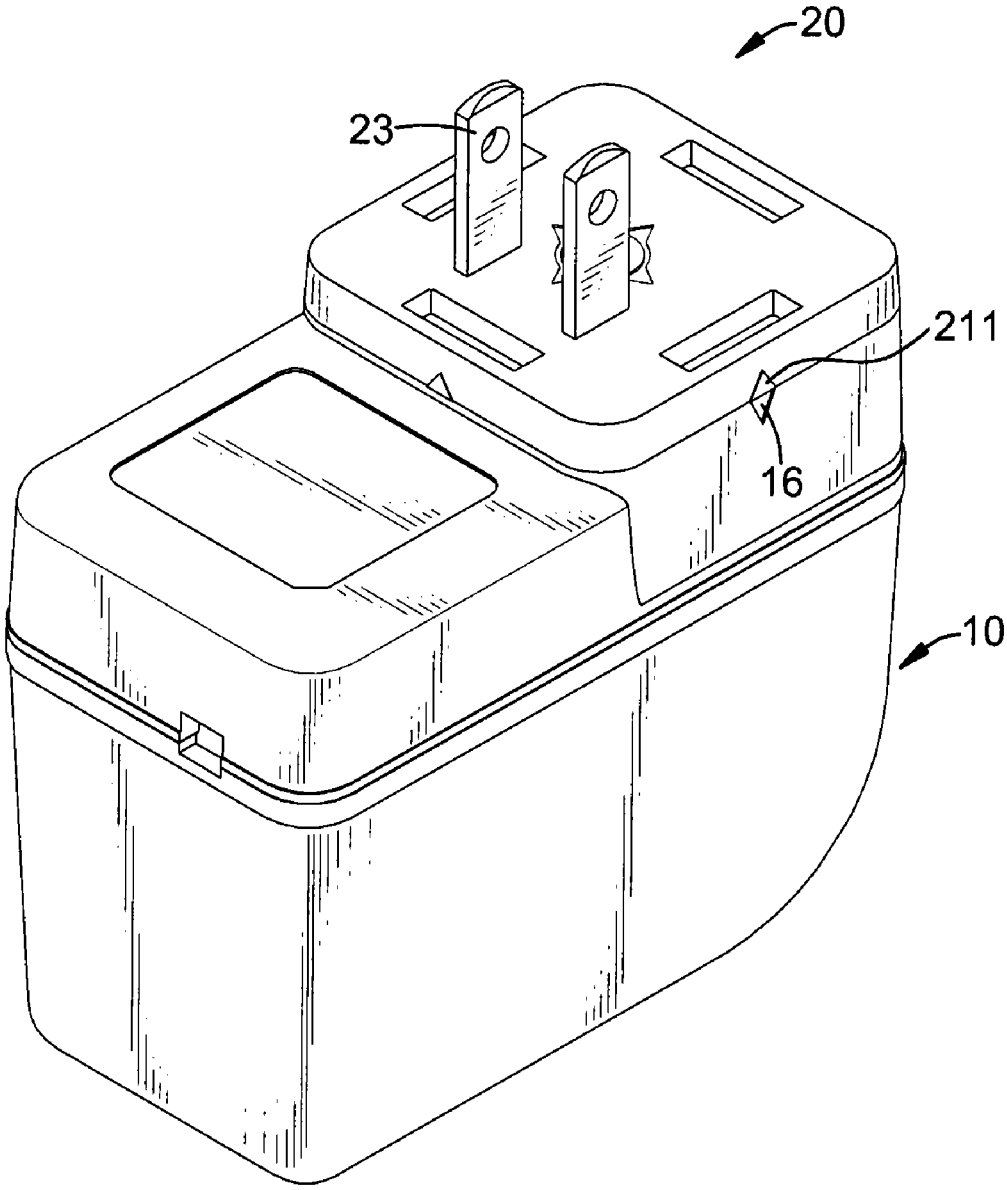
FIG. 6 is a perspective view of the converter in FIG. 5.

With further reference to FIGS. 5 and 6, the position groove (222) of the plug (20) is annular formed in the engaging protrusion (22) to mount around the position posts (12) of the casing (10) and the distance between the two terminals (23) is equal to or smaller than the specified distance of the adjacent position posts (12). Then, the two terminals (23) can be aligned with two of the position posts (12) and contacted with the conductive slices (13) that mounted on the corresponding position posts (12) at the same time. When the converter is interfered with the object or the structure that mounted around the power outlet and the plug can be adjusted and changed the direction at a angle of 90, 180 or 270 to mount with the power outlet and this is convenient in use.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A converter comprising:

a casing having a connection side;

an external surface;

a mounting recess being formed in the connection side of the casing and having a bottom, an annular sidewall and a center;

multiple position posts being formed on and protruding from the bottom of the mounting recess around the center of the mounting recess and each position post having an external surface;

multiple conductive slices being mounted around the position posts; and multiple mounting protrusions being formed on the annular sidewall of the mounting recess; and a plug being detachably mounted on the casing and having an escutcheon covering the mounting recess of the casing and having an outer side;

a connection side; and an external surface;

an engaging protrusion being formed on and protruding from the connection side of the escutcheon, being mounted in the mounting recess of the casing and having a center;

an outer sidewall;

a position groove being annular formed in the engaging protrusion around the center of the engaging protrusion and being mounted around the position posts of the casing; and multiple holding grooves being formed on the outer sidewall of the engaging protrusion and engaging the mounting protrusions of the casing; and multiple terminals being formed on and protruding from the outer side of the escutcheon, and each terminal being contacted with one of the conductive slices of the casing.

2. The converter as claimed in claim 1, wherein the casing has multiple datum marks formed on the external surface of the casing near the connection side of the casing; and the escutcheon has multiple confirm marks formed on the external surface of the escutcheon and corresponding to and aligning with the datum marks of the casing.

3. The converter as claimed in claim 2, wherein the casing has an engaging tab being formed on and protruding from the bottom of the mounting recess near the center of the mounting recess and between the position posts; and the engaging protrusion has an engaging hole being formed in the center of the engaging protrusion to engage the engaging tab of the casing.

4. The converter as claimed in claim 3, wherein the casing has four position posts being formed on and protruding from the bottom of the mounting recess, and each pair of adjacent position posts has a specified distance; and the plug has two terminals being formed on and protruding from the outer side of the escutcheon and a distance between the terminals being equal to or smaller than the specified distances of the adjacent position posts.

5. The converter as claimed in claim 1, wherein the casing has an engaging tab being formed on and protruding from the bottom of the mounting recess near the center of the mounting recess and between the position posts; and the engaging protrusion has an engaging hole being formed in the center of the engaging protrusion to engage the engaging tab of the casing.

6. The converter as claimed in claim 1, wherein the casing has four position posts being formed on and protruding from the bottom of the mounting recess, and each pair of adjacent position posts has a specified distance; and the plug has two terminals being formed on and protruding from the outer side of the escutcheon and a distance between the terminals being equal to or smaller than the specified distances of the adjacent position posts.

* * * * *